US007610722B1

(12) United States Patent
Carroll

(10) Patent No.: US 7,610,722 B1
(45) Date of Patent: Nov. 3, 2009

(54) SEAMLESS RAIN GUTTER SYSTEM

(76) Inventor: Brice Q. Carroll, 388 Grandstaff Dr., Hot Springs, AR (US) 71913

( * ) Notice: Subject to any disclaimer, the term of this patent is extended or adjusted under 35 U.S.C. 154(b) by 473 days.

(21) Appl. No.: 11/347,919

(22) Filed: Feb. 6, 2006

(51) Int. Cl.
*E04D 13/08* (2006.01)
*D04C 3/00* (2006.01)
*F16L 9/00* (2006.01)

(52) U.S. Cl. ..... 52/16; 52/12; 52/844; 138/165; 138/167; 138/168; 210/474; 248/48

(58) Field of Classification Search ..... 52/11–16, 52/836, 842–844, 220.8; 210/499, 477–481, 210/162, 163, 474, 482; 248/48.1, 48.2; 138/119, 118, 162, 165, 167, 168
See application file for complete search history.

(56) References Cited

U.S. PATENT DOCUMENTS 2,988,226 A 6/1961 Campbell
3,057,117 A 10/1962 Singer
3,076,669 A * 2/1963 Schlein ..... 285/179
3,550,381 A 12/1970 South
3,741,398 A 6/1973 Abramson
3,825,288 A * 7/1974 Maroschak ..... 285/133.6
3,913,284 A 10/1975 Hall
4,134,002 A 1/1979 Stanford
4,195,452 A 4/1980 Smith et al.
4,305,236 A 12/1981 Williams
4,446,658 A 5/1984 Gouin
4,473,973 A 10/1984 Lane
4,553,356 A 11/1985 Pepper
4,619,554 A * 10/1986 Walker et al. ..... 405/120
4,622,785 A 11/1986 Miller
4,631,875 A 12/1986 Olson
4,632,342 A * 12/1986 Skinner ..... 248/48.2
4,650,224 A * 3/1987 Smith ..... 285/145.5
4,727,689 A 3/1988 Bosler
4,765,101 A * 8/1988 Wolf ..... 52/12
4,858,396 A 8/1989 Rose et al.
4,912,888 A 4/1990 Martin
4,953,735 A * 9/1990 Tisbo et al. ..... 220/6
4,953,897 A * 9/1990 Klober ..... 285/226
5,007,146 A 4/1991 Meidan
5,016,404 A 5/1991 Briggs
5,181,793 A 1/1993 Dekel
5,216,852 A * 6/1993 Bemis et al. ..... 52/12
5,311,753 A * 5/1994 Kanao ..... 68/208
5,327,689 A 7/1994 Jansen
5,375,891 A * 12/1994 Sicotte et al. ..... 285/148.22
5,394,656 A 3/1995 Parker
5,404,686 A 4/1995 Esposito
5,406,756 A * 4/1995 Bemis et al. ..... 52/16
5,511,829 A * 4/1996 Sicotte et al. ..... 285/148.22

(Continued)

*Primary Examiner*—Robert J Canfield
*Assistant Examiner*—Babajide Demuren
(74) *Attorney, Agent, or Firm*—J. Charles Dougherty

(57) ABSTRACT

A seamless guttering system formed of flat, seamless plastic is disclosed. The gutter material is thinned along longitudinal lines to be bent into a "U" shape, and includes connectors molded integrally with the flat material to lock the gutter into the proper form. The system also includes a seamless top piece that may be used to close the "U" shape into a box shape for the purpose of forming a downspout. A seamless hanger piece with connectors may be employed, or the gutters may be mounted directly to the building. Various seamless leaf guards may be employed in alternative embodiments. Flexible corner and downspout connectors complete the system.

15 Claims, 11 Drawing Sheets

U.S. PATENT DOCUMENTS 5,551,201 A 9/1996 Anderson
5,570,860 A 11/1996 Schoenherr
5,611,175 A 3/1997 Sweers
5,634,299 A * 6/1997 Gaston ..... 52/12
5,638,643 A 6/1997 Demartini et al.
5,678,360 A * 10/1997 Fort et al. ..... 52/14
5,752,347 A 5/1998 Osborn
5,794,315 A 8/1998 Crabtree et al.
5,813,701 A * 9/1998 Noble ..... 285/4
5,867,943 A * 2/1999 Thomas ..... 52/11
5,915,735 A * 6/1999 Noble ..... 285/4
5,960,591 A 10/1999 Schluter
6,041,825 A * 3/2000 Smith et al. ..... 138/109
6,125,593 A * 10/2000 Randolph et al. ..... 52/16
6,223,777 B1 * 5/2001 Smith et al. ..... 138/109
6,308,464 B1 * 10/2001 Demartini ..... 52/16
6,497,816 B2 * 12/2002 Naddy ..... 210/162

* cited by examiner

SEAMLESS RAIN GUTTER SYSTEM

BACKGROUND OF THE INVENTION

The present invention relates to rain gutter and downspout systems, and in particular to such systems with principal components formed of flat, seamless material that may be distributed on a spool and cut to a desired length.

Rain gutter and downspout systems are widely employed on commercial and residential buildings to direct rainfall to a desired location, thereby preventing erosion and the other deleterious effects of uncontrolled water run-off from building roofs. The U.S. market for rain guttering systems is large, exceeding one billion dollars annually. Those rain gutter systems on the market today fall into one of three major classes: vinyl sectional, metal sectional, and seamless metal. A fourth method, currently only used to a very small extent in Canada, is fused (or "virtually seamless") vinyl.

Vinyl sectional rain gutter systems are constructed from pre-formed sections of U-shaped plastic material, usually ten feet in length. Because no expensive, customized equipment is necessary for the installation of sectional vinyl pieces, this class of rain gutter systems is the preferred choice of do-it-yourself installers. Sectional systems, however, are time-consuming to install, as connectors are required at each point where the pre-formed sections are fitted together. These connectors are prone to leak or otherwise fail after the system has been in place for some time. The connectors also increase the cost of this type of guttering system. One connector costs approximately two-thirds as much as a ten-foot gutter section. The connectors must be designed to allow for the high degree of expansion and contraction that occurs in the vinyl material due to changes in temperature. Another important disadvantage of this type of system is that the connectors ruin the smooth, uninterrupted appearance of the gutters, and thus may negatively impact the appearance of the home or other building upon which the gutters are installed. Appearance is known to be an important factor in the selection of a guttering system, particularly with respect to homes and retail business establishments.

Another factor adding to the cost of sectional vinyl gutter systems is the required hangers and downspouts. In order to prevent sagging, vinyl sectional guttering systems require hangers to be installed from the building at approximately two-foot intervals along each gutter section. The price of hangers for a typical installation project will be more than double the price of the ten-foot gutter sections themselves. The increased cost is a result of forming the connectors and hangers from the more expensive injection-molding technique required. Extruded plastic is much less expensive than injection-molded plastic. The downspouts for such systems are pre-formed into rectangular tubes, generally ten feet in length, and each such length is generally priced at one and one-half to two times the price of a ten-foot, U-shaped gutter section. It may thus be seen that much of the cost of this type of guttering system is hidden in the auxiliary components necessary for the installation of the complete system.

Metal sectional rain gutter systems are, like the vinyl sectional systems, constructed of pre-form U-shaped sections, again generally of ten-foot lengths. The sections in most metal gutter systems are constructed from aluminum, due to its low cost, relatively light weight, and resistance to corrosion. Copper and stainless steel sections are other options, but due to the prohibitively high cost of these materials they are seldom used. Like the vinyl sectional systems, the metal sectional systems also suffer from a number of disadvantages. Aluminum is easily bent, and once a bend occurs it is difficult or impossible to fully restore without the damage being visible. Each of the aluminum guttering system components must be painted for purposes of appearance, and any chip or nick in the paint will be highly visible. The installation of such a system is time-consuming due to the necessary use of connectors, which, as in the case of vinyl sectional systems, significantly drive up the cost of these systems. Also as with the vinyl sectional systems, the connectors ruin the clean, neat appearance of the guttering system.

Metal seamless, or continuous, guttering systems are formed on-site from flat sheets of metal. The flat metal, typically aluminum, is pulled from a spool or roll, cut to the appropriate length, and then bent or formed into the proper U-like shape by the use of a special forming machine. The downspouts of this type of system are typically pre-formed into a rectangular cross-sectional shape. Because the gutters are cut to the desired length on-site, this type of system require no connectors along the length of the building roofline, and thus provide the neat appearance that sectional gutter systems lack. For this reason, metal seamless guttering is by far the most popular choice for home guttering in the United States. This class of guttering system is, however, far more expensive than sectional guttering because of the requirement of a professional installation crew and forming machine on-site. The forming machine necessary to install metal seamless guttering costs an estimated $12,000 to $20,000, placing it well out of reach of typical do-it-yourself installers. The machine also requires special training for proper and safe use, thus discouraging a rental market for the forming machines. Like sectional metal guttering systems, the components of this system are highly susceptible to bending and chipping of paint.

A newer product on the market is fused vinyl, or "virtually seamless" vinyl guttering. This product is sold exclusively to gutter installation specialists and is currently available only in Canada. Using this system, the vinyl sections are fused together on-site by means of a fusing machine operated by the gutter installation crew. The beaded seam is then trimmed or sanded. Although the seam is thus still visible, it is not as glaringly visible as the connectors of traditional sectional guttering. Like seamless metal guttering, this type of guttering system is expensive, and not available for do-it-yourself installers. The machine used to fuse the guttering material costs an estimated $6,000 to $10,000, and, like the forming machine used for metal seamless gutters, is not safe for use by untrained do-it-yourselfers. Although this machine has a lower cost than that of the forming machine used for seamless metal guttering, the installation process for fused vinyl takes roughly twice as long, which drives up labor costs associated with installation. The hangers used for this type of guttering system, like the hangers used for vinyl sectional guttering, require injection molding, and are required at about every two feet of guttering length.

It may be seen that each of the existing classes of guttering systems suffer from important disadvantages. What is desired then is a guttering system that provides the neat appearance of seamless guttering but that does not require specialized equipment to form the guttering pieces from a flat roll on site. In particular, such a guttering system would be highly desirable if such system were safe and otherwise appropriate for installation by do-it-yourself homeowners.

The prior art does contain an attempt to develop a seamless plastic material for a gutter-related application. U.S. Pat. No. 6,308,464 to Demartini teaches a downspout for use with a rain gutter that is formed from a flat plastic sheet disposed on a roll prior to construction. The necessary downspout length is cut from the roll, then the sheet is bent into the desired shape, which may be either a rectangular or oval cross-sectional configuration. Bending is facilitated in the rectangular configuration by longitudinal regions in the plastic sheet that comprise a more flexible plastic material than the material used to form the bulk of the sheet. Alternatively, the plastic material forming the sheet may be made thinner where the bends are to occur so that the material will be more flexible at these locations.

While Demartini '464 teaches a downspout system formed using a plastic material that may be cut to a desired length, the system falls far short of a complete seamless guttering system, or even a gutter itself. Neither the rectangular nor oval configuration used for the downspout of Demartini '464 could be used for gutters, since the rainwater would have no means of entering the gutter when deployed. No system for connecting the pieces of such a system are taught by Demartini '464, since, due to the fact that Demartini '464 is limited to the use of a downspout for an existing gutter system, no such connectors are required. In addition, Demartini's downspout has no mechanism to lock and hold the rectangular or oval shape along its length. This will allow the downspout to twist and bulge out of shape between points of anchorage to the wall of the building. Also, without locking mechanisms the downspout material will be wavy after being wound on a spool. What is desired then is a complete guttering system that is formed of a continuous flexible sheet, providing the advantages of such a system that are described herein.

SUMMARY OF THE INVENTION

The present invention is directed to a seamless gutter system that is formed of flat plastic material. The flat material is thinned along longitudinal strips in the plastic sheet, thereby allowing the material to be folded once it is cut to length. The folding system results in a generally U-shaped configuration for the gutter produced by this method. Optionally, a leaf guard may be placed onto the gutter, the leaf guard being formed from another plastic sheet, which may similarly be provided in a roll and cut to length. Tabs that are preferably integrally molded into the flat plastic material hold the "U" shape of the gutter, so that no reinforcement is required. A downspout may be formed of the same material as the gutter, with a downspout "top cap" closing the three sides of the U-shaped gutter to create a closed downspout piece. Corner connectors and optional hangers complete the system, all of which may be formed of vinyl or other plastic material for durability, ease of installation, and low cost.

It may be seen that such a system results in a guttering system that provides a neat, uninterrupted appearance similar to that of metal seamless guttering. The present invention, however, provides this neat appearance at a much lower cost, since no specialized forming machine is required at the job site. The need for trained forming machine operators is thus eliminated also, making the present invention ideally suited for do-it-yourself installation, as well as installation by professional gutter contractors. The rolls of material and other components of the system could preferably be available for purchase at a retail outlet, such as a home-improvement store, whereby the homeowner would need only to bring his or her home measurements to the store in order to purchase the necessary lengths of material and related components. In addition, it may be seen that the present invention would be desirable by building contractors as well; contractors currently must hire or train gutter installation specialists in order to install seamless metal guttering, but by employing the present invention could use their own general construction labor for the installation process, thereby lowering the costs associated with each project involving a gutter installation. In addition, independent gutter installation contractors can install seamless gutters without the requirement of an expensive bending or forming machine.

It is therefore an object of the present invention to provide for a seamless guttering system formed of a plastic or other flexible material.

It is a further object of the present invention to provide for a guttering system that is inexpensive to purchase and install.

It is also an object of the present invention to provide for a guttering system that may be installed by a do-it-yourself homeowner or other untrained person or persons.

It is also an object of the present invention to provide for seamless guttering without the requirement of an expensive bending or forming machine.

It is also an object of the present invention to provide a seamless gutter, which combined with a seamless top cap that can be snapped onto the gutter, can be converted into a seamless downspout.

It is also an object of the present invention to provide for a guttering system that has a clean, attractive appearance.

These and other features, objects and advantages of the present invention will become better understood from a consideration of the following detailed description of the preferred embodiments and appended claims in conjunction with the drawings as described following:

DRAWINGS

FIG. 6 is a perspective view of a corner connector according to a preferred embodiment of the present invention.

DETAILED DESCRIPTION OF THE PREFERRED EMBODIMENTS

Figure 1A:
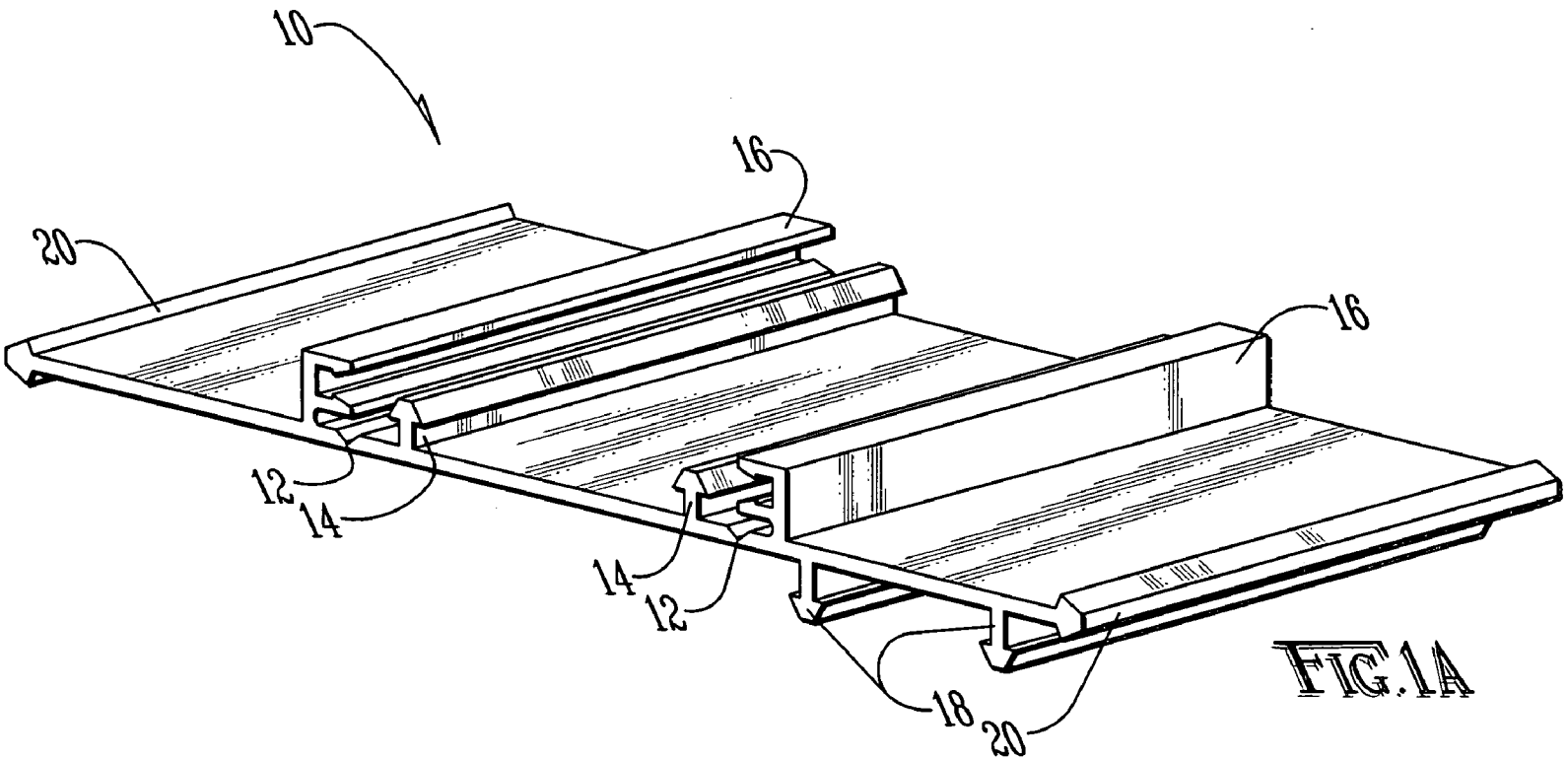
FIG. 1A is a perspective view of a flat gutter section according to a preferred embodiment of the present invention.
Figure 2:
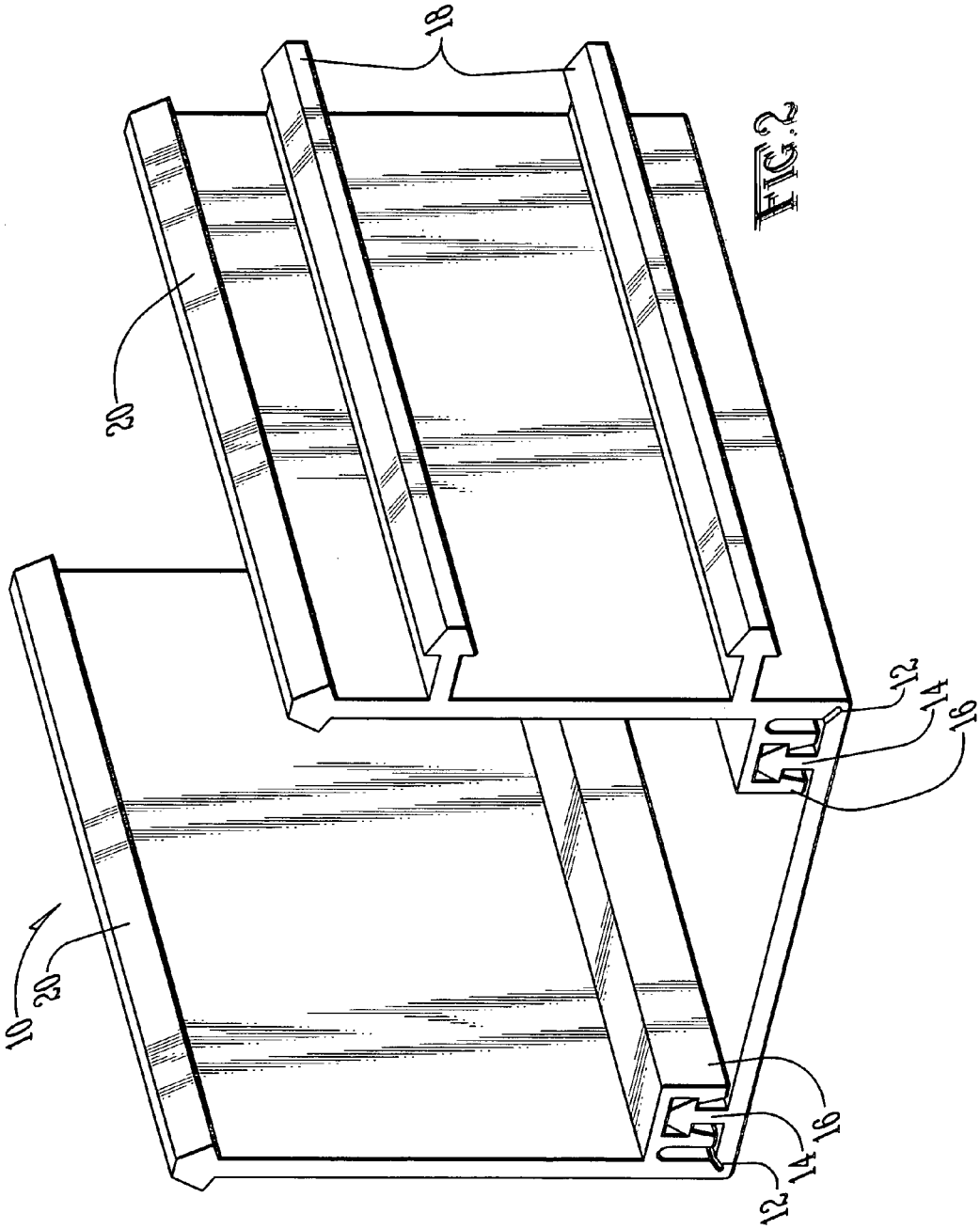
FIG. 2 is a perspective view of a folded and deployed gutter section according to a preferred embodiment of the present invention.

With reference to FIGS. 1A and 2, a section of the U-shaped gutter material used in a guttering system according to a preferred embodiment of the present invention may now be described. Guttering section 10 is preferably formed of vinyl, but may be formed of other flexible materials. The vinyl is preferably formed by means of the extrusion method, but other methods may be used in alternative embodiments, such as injection molding. Guttering section 10 is molded with a series of thinned strips and interlocking tabs that are adaptable, as will be described, to hold the gutter into a "U" shape when installed. Each of these features are preferably integrally molded with the material of guttering section 10 as shown in FIG. 1A. Specifically, two longitudinal strips of thinner material 12 in guttering section 10, shown in FIG. 1A, appear at the location where bends must occur in order to form the "U" shape depicted in FIG. 2. These thinned strips force the guttering section 10 to bend first at thinned strips 12 when pressure is applied upward at each edge during the forming step prior to installation. An inner tab 14 and an outer tab 16 appear at each of the inner and outer edges of each thinned strip 12, respectively. It may be noted that this tab configuration could well be reversed in alternative embodiments. In further embodiments, one of the tabs may comprise a slot to receive a protrusion on the opposite tab. The term "tab," as used herein, is intended to encompass any means of locking the gutter together in the U-shaped position. When deployed in the preferred embodiment as illustrated in FIG. 2, outer tab 16 fits over inner tab 14, with the extending lip of outer tab 16 locking in place under the lip of inner tab 14. A frictional fit is thereby formed between each inner tab 14 and outer tab 16 to hold the "U" shape of the deployed guttering section 10. Again it may be noted that, in alternative embodiments, various other types of locking tabs, with or without matching protrusions, lips, or receiving slots, may be employed within the scope of the present invention.

In the preferred embodiment, spaces, slits, or gaps (not shown in FIG. 1A) may be placed periodically within the length of inner tabs 14 and outer tabs 16. The purpose of the spacing is to enable to product to be more easily spooled without stretching or bending due to the resistance to lateral bending of the thick tabs. The spaces or gaps provided in inner tabs 14 are preferably offset from those of outer tabs 16; in this way, the slits will not compromise the rigidity of the resulting gutter system when gutter section 10 is in the deployed "U" shape with inner tabs 14 and outer tabs 16 locked together. Similar spaces or gaps may be provided for this purpose in hanger tabs 18 (the purpose of which will be described below).

Figure 1B:
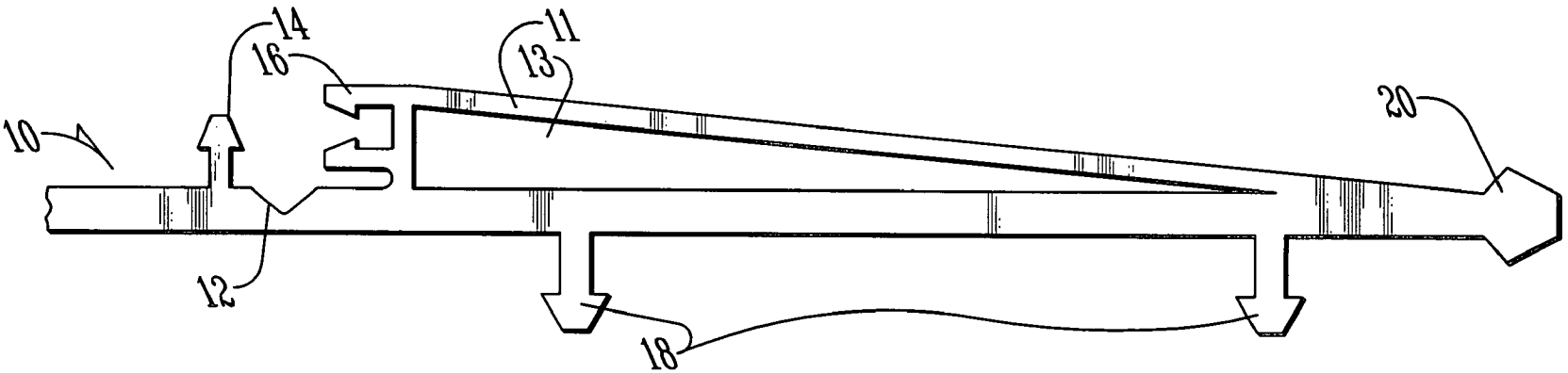
FIG. 1B is a side elevational view in cut-away of a flat gutter section with non-uniform wall thickness according to an alternative embodiment of the present invention.

While in the preferred embodiment the thickness of the wall of gutter section 10 is uniform, as shown in FIG. 1A, the thickness may be varied in alternative embodiments to improve the strength of the resulting gutter system. For example, those portions of gutter section 10 that corresponds to the gutter sides when assembled may be progressively thicker towards the bottom of the gutter, thereby increasing the rigidity of the system when locked into the deployed "U" shape. The result is thickened side walls 11, as depicted in FIG. 1B. Since the maintenance of a uniform total material thickness across the width of the material simplifies the process of producing plastic products by means of extrusion, it is preferred to construct such a wall with a cavity 13 within the thickened portion, whereby the total material thickness remains laterally uniform.

Figure 3:
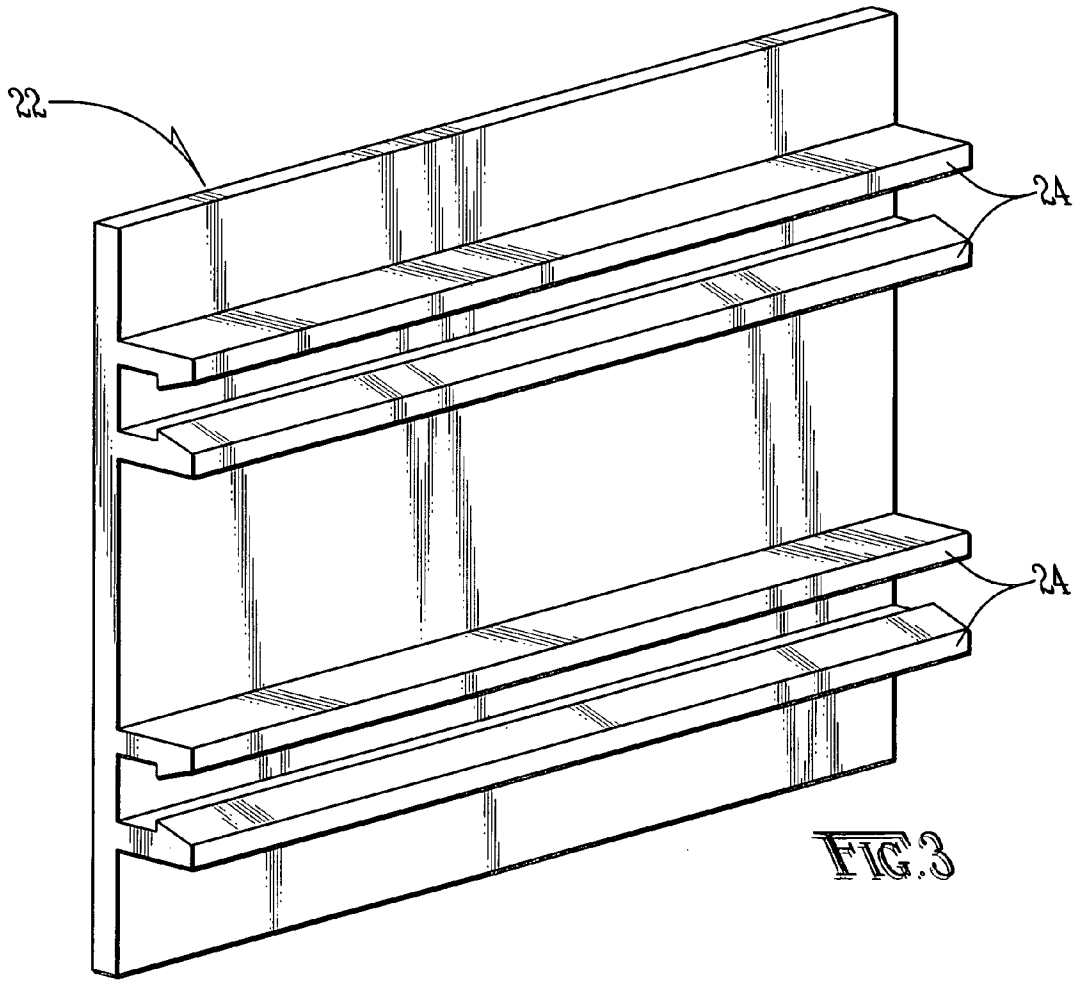
FIG. 3 is a perspective view of a hanger section according to a preferred embodiment of the present invention.

Referring now to FIG. 3 in conjunction with FIGS. 1A and 2, a hanger and mounting method may be described with respect to the preferred embodiment of the present invention. Hanger section 22 and the tabs extending from it are preferably molded of a single, integral piece in the same general manner as described above with respect to gutter section 10. Hanger section 22 is adapted to receive and hold gutter section 10 in place by means of gutter male tabs 18 and hanger female tabs 24. As may be seen by comparison of FIGS. 2 and 3, the deployed gutter section 10 may be fitted to hanger section 22 by applying pressure behind hanger male tabs 18 to cause them to snap into the space created by each pair of hanger female tabs 24. The lip on these tabs causes gutter section 10 to be securely held in place with respect to hanger section 22. The gutter male tabs will preferably fit securely, but somewhat loosely, within the hanger female tabs, to allow the gutter to slide along the hanger as it expands and contracts. Various other types of tabs may be used in alternative embodiments.

In the preferred embodiment, hanger section 22 is mounted to the eave or otherwise just below the roof line of the building upon which the preferred embodiment is to be installed. This mounting may be by screws, staples, or other means. Holes (not shown) may optionally be periodically placed along the length of hanger section 22 for this purpose.

Gutter sections 10 and matching hanger sections 22 are cut to length for use based on the length of each section needed for the particular application. A homeowner, builder, or contractor could thus measure the dimensions of the roof perimeter of the home for which guttering is desired, and bring those measurements to a home improvement store or other vendor that makes available the preferred embodiment for purchase. The gutter section 10 material is preferably kept on a roll or spool, and can thus be unwound and cut to the length indicated by the customer's dimensions. In this way, no connectors are needed during long runs of the guttering material along straight roofing lines, thereby presenting a neat appearance and avoiding the cost of purchasing connectors for this purpose.

In alternative embodiments, hanger sections 22 may be omitted from the system as described above, and gutter sections 22 may be connected directly to the building eaves or otherwise just below the roof line. Holes (not shown in FIG. 1A) may be optionally included in the side of gutter section 10 in the area where male tabs 18 are shown in FIGS. 1 and 2 for the purpose of receiving screws or other hanging hardware. If this alternate embodiment is used, FIG. 1A cap connector 20 will be a female connector rather than a male connector. In addition, FIG. 4 leaf guard cap section 26 and FIG. 9 downspout conversion cap section 44 will be male connectors rather than female.

Figure 4:
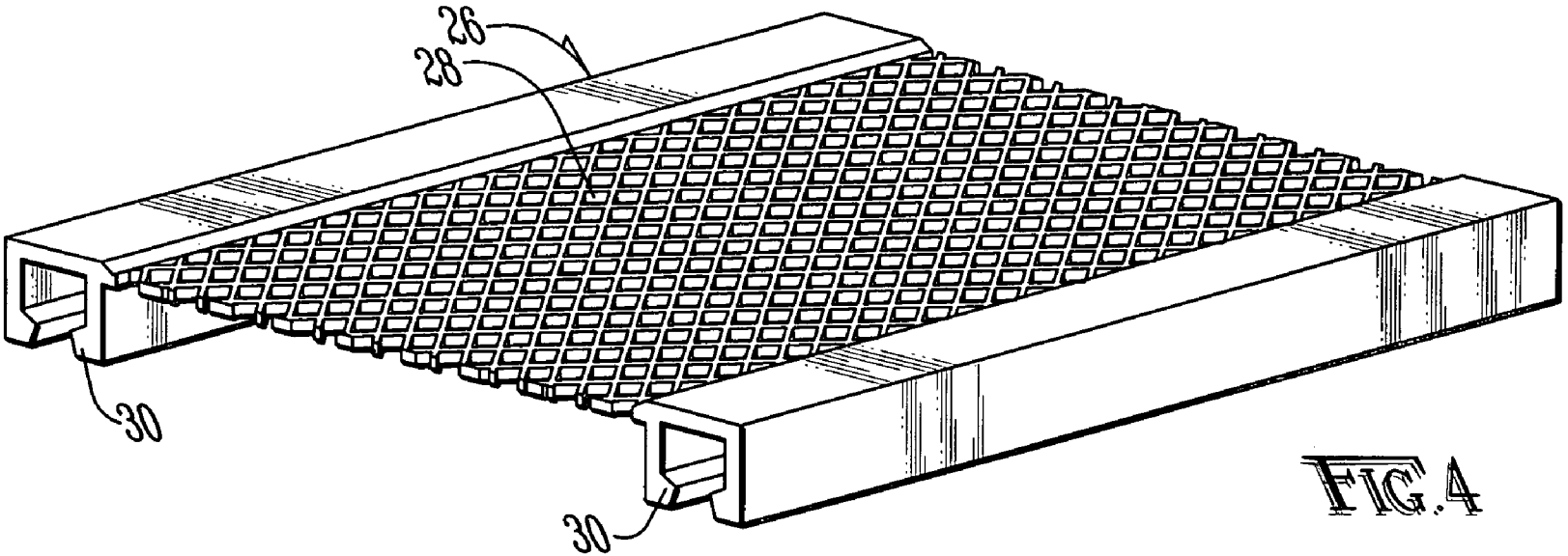
FIG. 4 is a perspective view of a leaf guard section according to a preferred embodiment of the present invention.

Referring now to FIG. 4 in conjunction with FIGS. 1A and 2, a leaf guard "cap" section 26 for the preferred embodiment of the invention may be described. Leaf guard section 26 is an optional attachment to gutter section 10. In the preferred embodiment, screen 28 forms an integral part of leaf guard section 26, and like gutter sections 10 and hanger sections 22 it is provided on a roll and cut to length prior to use. In the preferred embodiment, female leaf guard tabs 30 on leaf guard section 26 are adapted to receive male leaf guard tabs 20 on gutter section 10 for the purpose of locking leaf guard section 26 in place. The form of screen 28 may be of any of various types designed to prevent the passage of debris but allow water to flow through. Screen 28 may comprise, for example, a series of slots or holes across the upper surface of leaf guard section 26, or overlapping or interlocking mesh creating passages between individual fibers or strands.

Figure 5A:
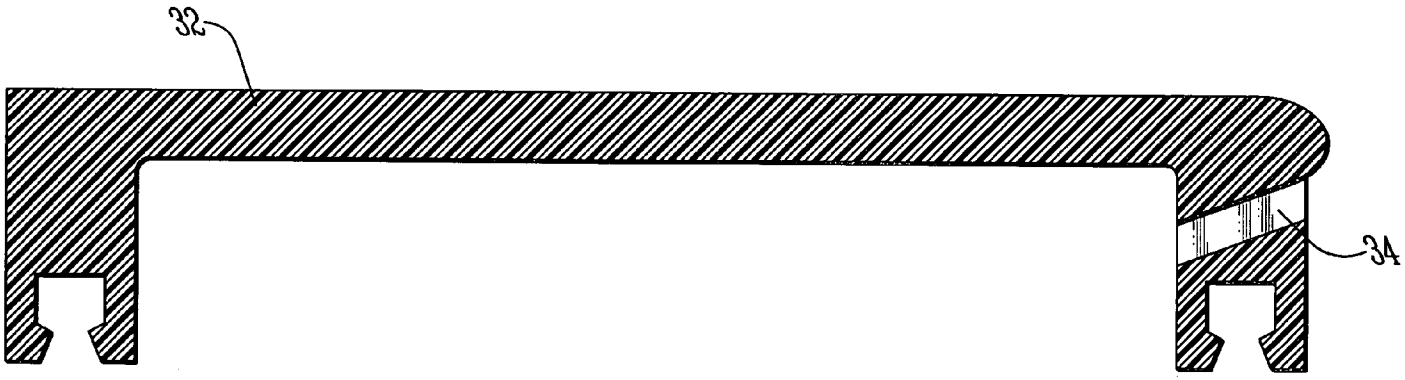
FIG. 5A is a side elevational view in cut-away of a leaf guard section according to an alternative embodiment of the present invention.
Figure 5B:
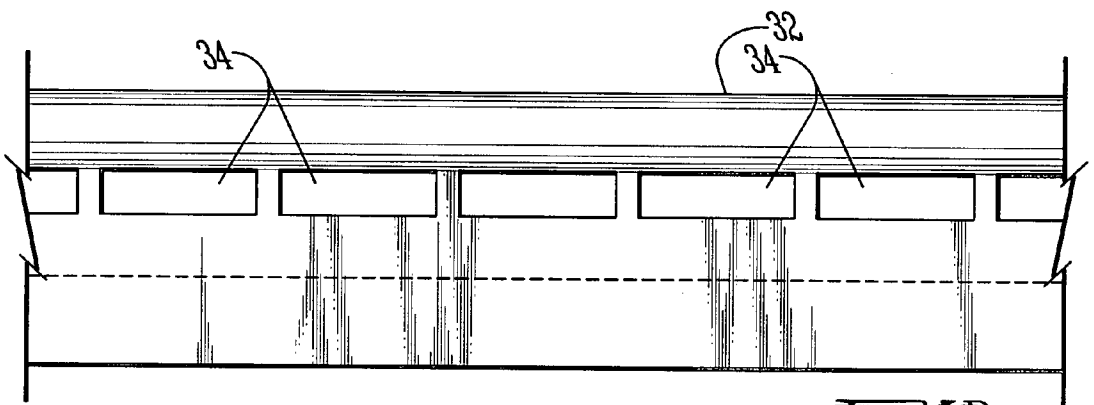
FIG. 5B is a front elevational view of a leaf guard section according to an alternative embodiment of the present invention.

In one set of alternative embodiments, screen 28 of leaf guard section 26 may be replaced with solid section 32 as depicted in FIGS. 5A and 5B. Slots 34 positioned underneath the lip extend from solid section 32 to receive water while blocking debris from entering the gutter. Water flows across the top of solid section 32, around the lip, and through slots 34 into gutter section 10 as a result of surface tension. The width of slots 34, and the distance between successive slots 34 in leaf guard section 26, may vary in various alternative embodiments.

A corner connector 36 according to a preferred embodiment of the present invention is depicted in FIG. 6. A rigid corner section 38 forms a U-shaped trough with a general shape that is congruent with that of an assembled gutter section 10, except that it includes a right angle to accommodate corners of the building to which the guttering system is attached. Corner connector 36 is attached to gutter sections 10 at expanding corner sections 40. Expanding corner sections 40 may be integrally molded with rigid corner section 38, or assembled with rigid corner section 38 in any secure manner as known in the art, but in the preferred embodiment the assembly is performed either by gluing or heat welding. The accordion-like structure of expanding corner sections 40 allows the assembled guttering system to expand and contract due to changes in temperature during the year, without damaging the system or causing its connection with the building to loosen. In the preferred embodiment, expanding corner sections 40 are each connected to a gutter section 10 by overlapping the parts and applying a glue appropriate to the material used for these parts. In an alternative embodiment, the connection is formed by configuring expansion edge 41 of each expanding corner section 40 as a slot or groove, whereby the gutter edge will act a matching tab or tongue at the end of gutter section 10, thereby forming a tongue-and-groove type connection.

Figure 9:
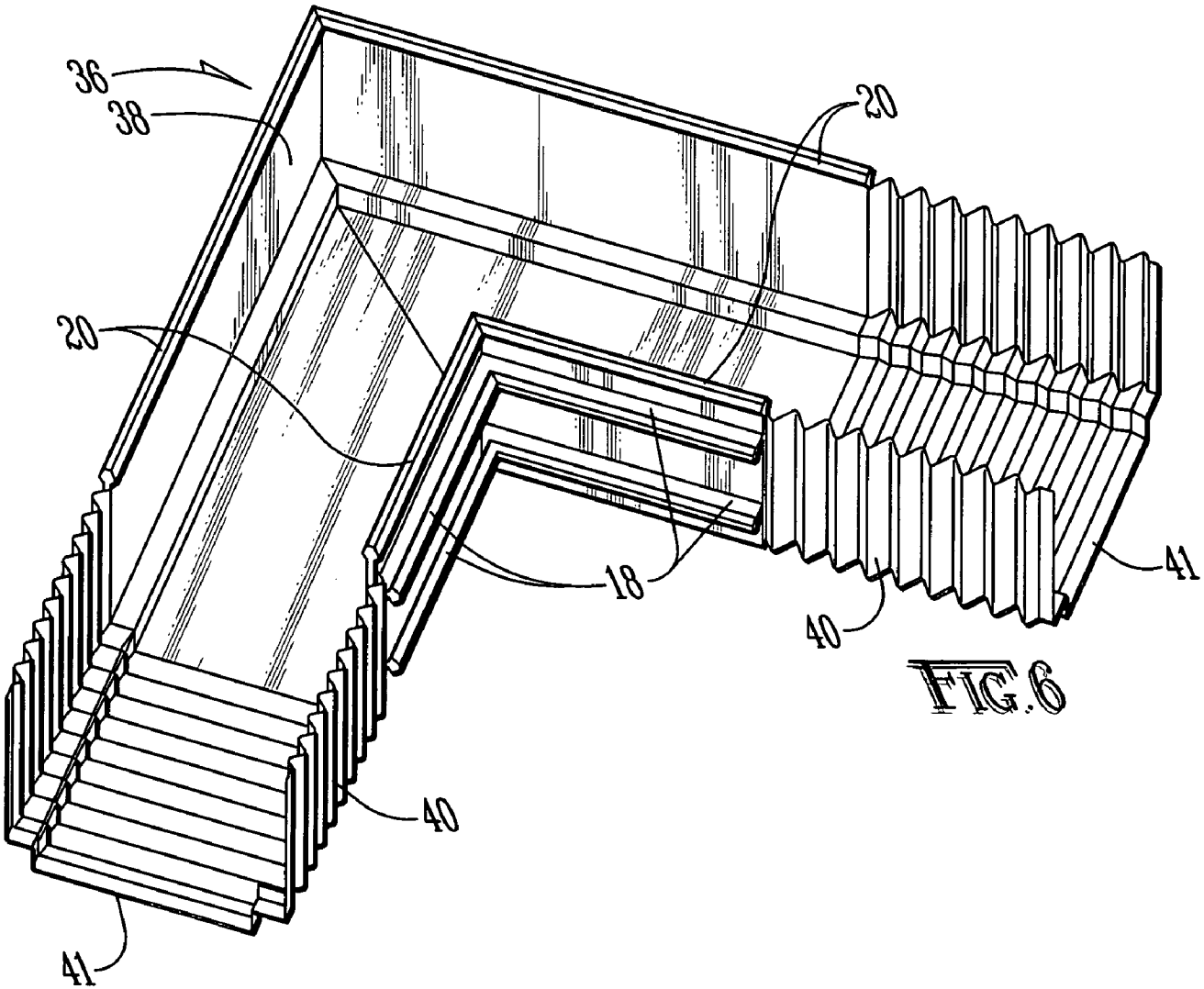
FIG. 9 is a perspective view of a downspout "conversion cap" wall section according to a preferred embodiment of the present invention.

Referring now to FIGS. 2 and 9, the downspout conversion "cap" portion of a preferred embodiment of the present invention may be described. A downspout for the guttering system is formed by the assembly of a gutter section 10, as depicted in its deployed U-shaped configuration in FIG. 2, and downspout section 42, as shown in FIG. 9. Like gutter sections 10, hanger sections 22, and leaf guard sections 26, downspout section 42 is preferably provided on a roll and cut to length prior to use. A corresponding length of gutter section 10 is also cut to form the downspout. In the preferred embodiment, female downspout tabs 44 on downspout section 42 are adapted to receive male cap tabs 20 on gutter section 10 for the purpose of locking downspout section 42 in place. The result is a four-sided pipe that is closed on all four sides. Alternative connection means as described with respect to gutter section 10 and leaf guard section 26 may also be employed in alternative embodiments.

Figure 7:
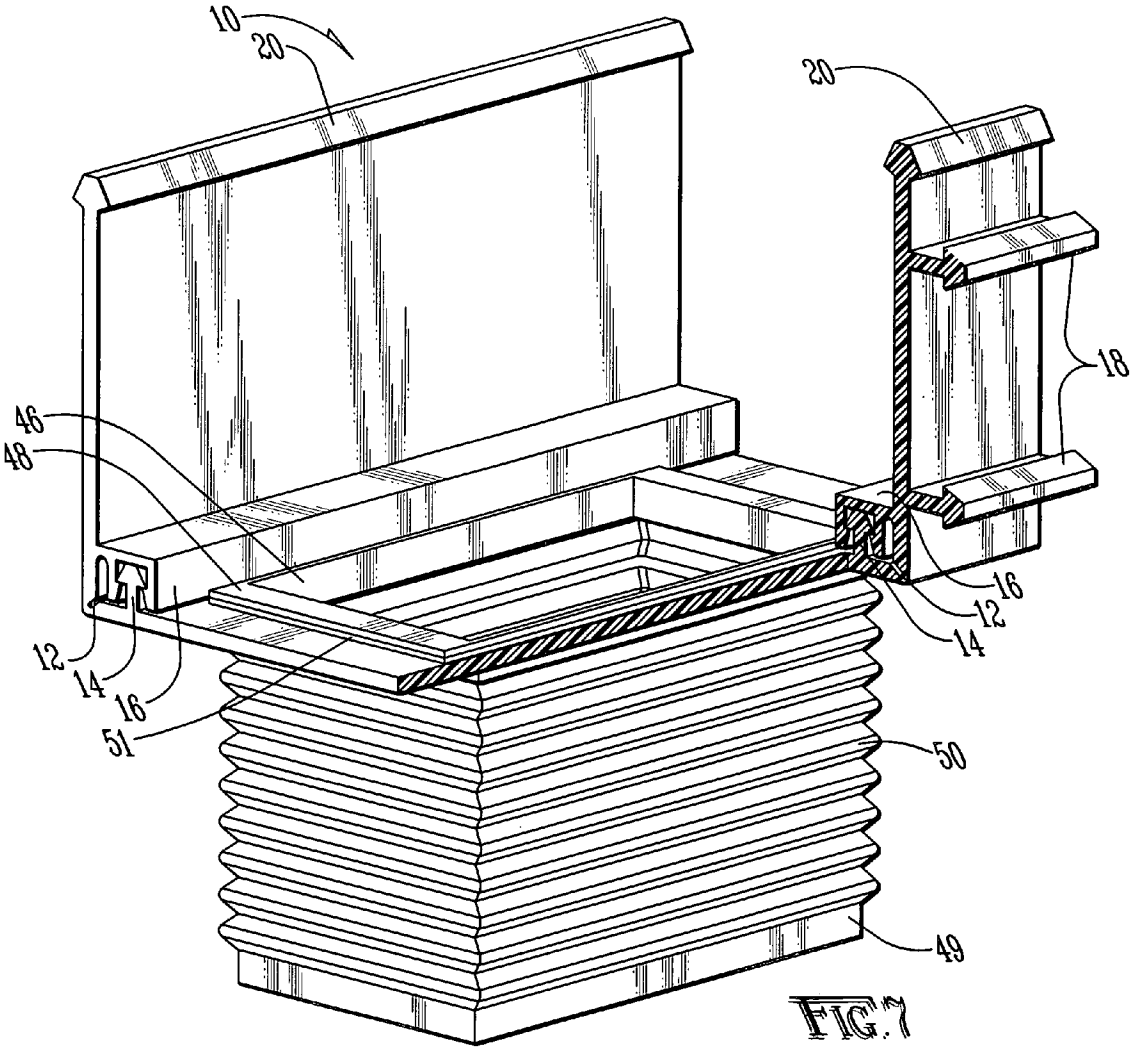
FIG. 7 is a perspective view of an assembled downspout connector, as attached to a gutter segment after a hole to receive the connector has been cut into the gutter by the installer, according to a preferred embodiment of the present invention.
Figure 8A:
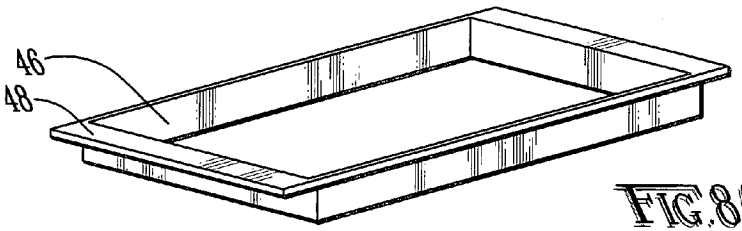
FIG. 8A is a perspective view of a downspout connector flange according to a preferred embodiment of the present invention.
Figure 8B:
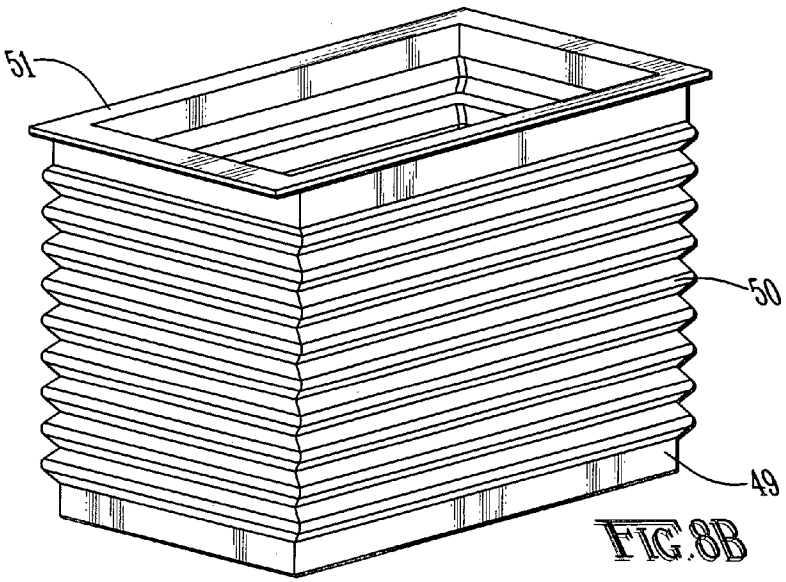
FIG. 8B is a perspective view of an expanding downspout connector according to a preferred embodiment of the present invention.
Figure 8:
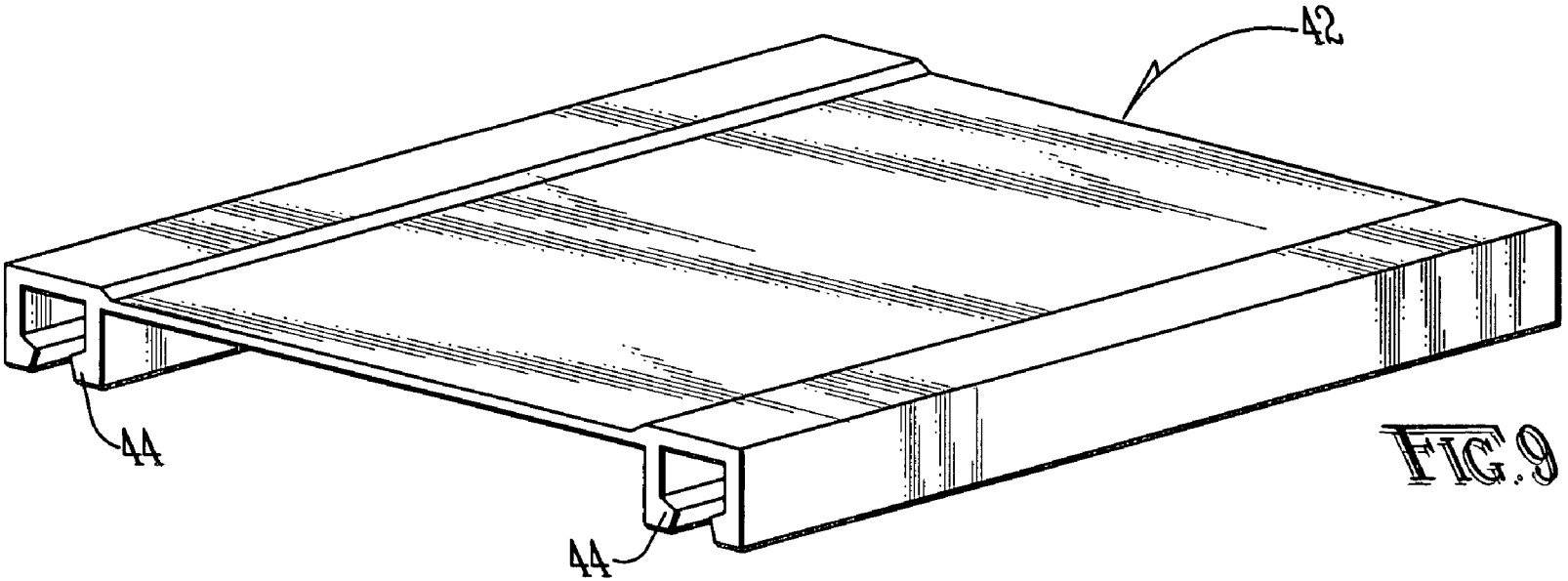

Referring now to FIGS. 7, 8A, and 8B, a downspout connection system for the preferred embodiment of the present invention may be described. The downspout connector of FIG. 7 is comprised of two components, a flange 46, shown in FIG. 8A, and an expanding/flexing downspout connector 50, shown in FIG. 8B. Flange 46 includes a lip 48 that is sized to fit within the bottom portion of a deployed gutter section 10. Flange 46 is further sized to fit within a hole that must be cut within the bottom portion of deployed gutter section 10, such that flange 46 is inserted from the top of gutter section 10, lip 48 rests on the top of the bottom portion of gutter section 10, and the remainder of flange 46 extends downwardly below gutter section 10. Since lip 48 has a greater circumference than the hole, lip 48 prevents flange 46 from passing entirely through the hole. Latitudinal lines of thinner material (not shown in FIGS. 1 and 2) may be molded into gutter section 10 extending between longitudinal thinned sections 12 at periodic intervals, to facilitate the cutting of a properly sized hole in the bottom of gutter section 10 at the location where the downspout is desired.

Once flange 46 is in place, expanding/flexing downspout connector edge 51 is fitted over flange 46 from the bottom side of gutter section 10, locking in place due to the friction between the parts. In alternative embodiments, scaling or tabs may be used on one or both of flange 46 and expanding/flexing downspout connector edge 51 to improve the shear strength of the friction fit between the parts. In other alternative embodiments, various connectors as are known in the art, such as screws and expanding brads, may be used to securely connect the parts. Expanding downspout connector 50 is designed to move laterally and longitudinally in accordion-like fashion in order to allow for the expansion and contraction of the guttering system components due to changes in temperature during the year. The expanding/flexing downspout connector 50 allows for vertical (longitudinal) expansion of the downspout, while at the same time allows flexing of the connector to compensate for the longitudinal movement of the gutter along the hanger as it contracts and expands, while the downspout is held in a fixed position against the side of the building. The downspout connector edge 49 can be glued to the edge of the downspout itself. Alternatively, the connector edge 49 can be configured as a slot or groove, and the downspout edge will act as a tongue, in a tongue-and-groove type connection.

Figure 10:
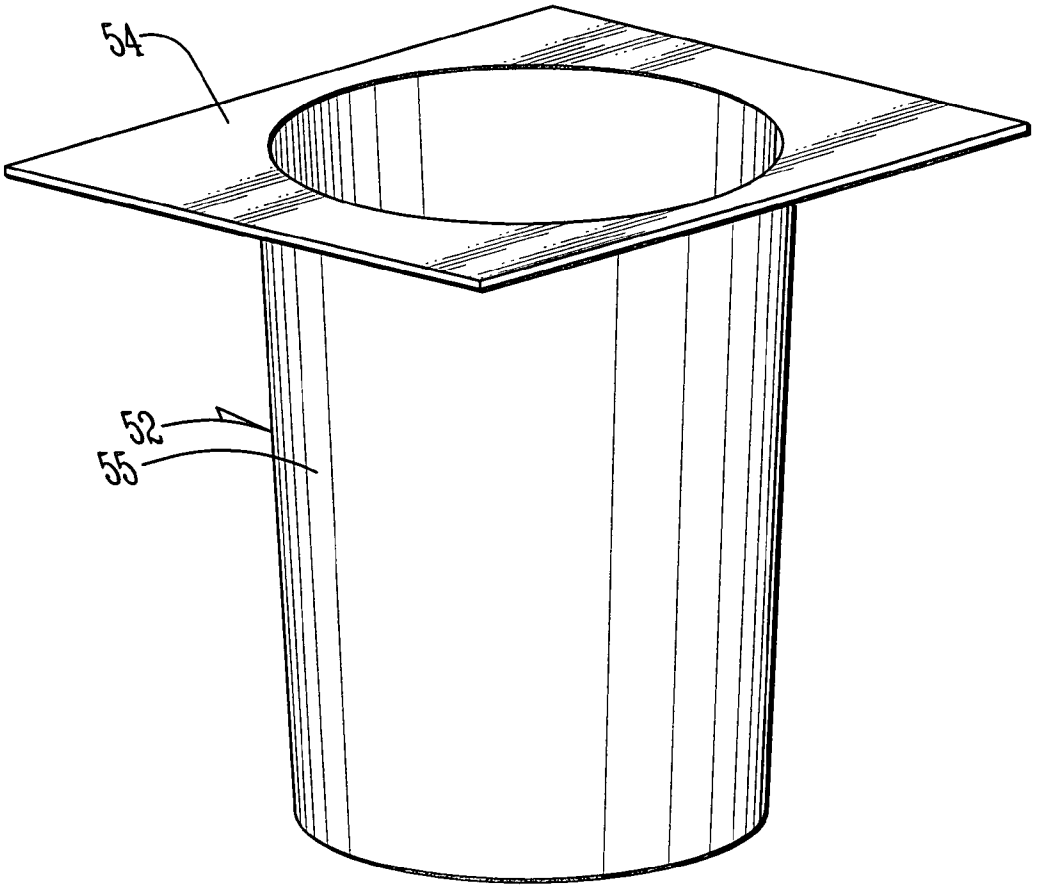
FIG. 10 is a perspective view of a circular downspout connector flange according to an alternative embodiment of the present invention.

FIG. 10 depicts an alternative downspout connector in circular flange 52. Like flange 46, circular flange 52 is fitted through a hole in gutter section 10 from the top, and lip 54 fits on the bottom of the gutter. Lip 54 is glued to the inside of the gutter bottom and the portion that protrudes beneath the gutter is placed loosely inside the downspout. The protruding portion 55 is not connected to the downspout, which allows it to move within the open end of the downspout as the gutter moves longitudinally along the hanger as it contracts and expands.

It may be noted that certain components of the invention are generally described herein as having a "U" shape when deployed. As used herein, this means that the sides are generally raised with respect to the bottom to form a shape that is at least somewhat reminiscent of a letter "U." In the case of gutter section 10 of the preferred embodiment, for example, this shape is desired because water is held and directed within the trough-like bottom portion of the "U," thereby functioning to catch and direct water to the desired location. This does not necessarily mean, however, that the sides of the component described as having a "U" shape are strictly perpendicular to the bottom of that component, or that the sides or bottom are necessarily flat or straight.

The material used in the construction of the preferred embodiment is vinyl. It may be noted, however, that other plastic materials may be used in alternative embodiments. Such materials may include, for example, polypropylene, or various laminates or cored materials that include plastic materials and non-plastic materials. In addition, the present invention, with relatively minor modifications, can be formed from relatively soft metals, such as aluminum or copper. The principal difference other than the material used in this embodiment is that a specially shaped cork or other cushioning material would preferably be wound on the spool or coil along with the metal. The purpose of the cushioning material is to keep the layers of metal from bearing on and bending the various tabs and channels of the gutter, hanger, leaf guard cap, and downspout conversion cap.

It may be noted that in an embodiment of the invention where plastic materials are used, the hanger, leaf guard cap, and downspout conversion cap parts are preferably formed of extruded plastic in order to limit costs. The corner connector should preferably be vacuum molded or injection molded for strength. Likewise, the downspout flange should be injected molded, and the expanding downspout connector is preferably blow molded. Each of these molding techniques are known in the art.

The present invention has been described with reference to certain preferred and alternative embodiments that are intended to be exemplary only and not limiting to the full scope of the present invention as set forth in the appended claims.

I claim:

1. A guttering system, comprising:

(a) at least one gutter comprising two side sections and a bottom section connected to each of said side sections, said sections being divided longitudinally by two thinned regions of said gutter, and said gutter further comprising an inner tab at a first side of each of said thinned regions and an outer tab opposite said inner tab at a second side of each of said thinner regions, wherein said outer tab comprises a channel comprising at least one sidewardly extending barb, and wherein said inner tab comprises a tongue and at least one sidewardly extending barb at a distal end of said tongue, whereby said outer tab may lockingly receive said inner tab by extending said tongue within said channel such that said inner tab barb extends behind said outer tab barb to lock said side sections in a raised position with respect to said bottom section;

(b) at least one corner connector with an open top and two ends each adapted to be received by said gutter, wherein said two corner connector ends form an angle;

(c) at least one downspout connector adapted to connect to said gutter; and (d) a downspout cap adapted to receive a gutter and thereby form a closed channel, and further adapted to connect to said downspout connector.

2. The guttering system of claim 1, further comprising a hanger adapted to connect to a building and further adapted to receive said gutter.

3. The guttering system of claim 2, wherein said gutter comprises at least one hanger tab extending rearwardly from a side section of said gutter, and said hanger comprises at least one hanger tab channel adapted to receive said hanger tab and thereby lock said gutter to said hanger.

4. The guttering system of claim 1, wherein said gutter comprises a series of openings at a side section adapted to receive fasteners for connecting said gutter to a building.

5. The guttering system of claim 1, further comprising at least one leaf guard cap formed of a separate piece than said gutter and adapted to connect with said gutter.

6. The guttering system of claim 5, wherein each of said side sections comprises a leaf guard tab at an upper edge of said side section, and said leaf guard cap comprises leaf guard channels adapted to receive each of said leaf guard tabs and thereby lock said leaf guard cap to said gutter.

7. The guttering system of claim 5, wherein said leaf guard cap comprises a screen opposite said gutter bottom section.

8. The guttering system of claim 5, wherein said leaf guard cap comprises a forwardly extending lip and a plurality of slots thereunder for channeling water from a top side of said leaf guard cap to an interior of said gutter.

9. The guttering system of claim 1, wherein said ends of said corner connectors are folded into a bellows-like shape.

10. The guttering system of claim 1, wherein said downspout connector comprises:

(a) an upper assembly adapted to be inserted through said gutter bottom section; and (b) a lower assembly substantially longer than said upper assembly and adapted to receive said upper assembly such that said lower assembly extends significantly below said upper assembly when assembled.

11. The guttering system of claim 10, wherein said downspout connector upper assembly comprises a lip adapted to rest in said gutter on a top side of said gutter bottom section and a flange designed to extend downwardly through said gutter bottom section, and wherein said lower assembly is designed to receive said flange.

12. The guttering system of claim 11, wherein said flange is one of square, rectangular, and circular in shape.

13. The guttering system of claim 10, wherein said downspout connector lower assembly is folded into a bellows-like shape.

14. The guttering system of claim 1, wherein at least one of said gutter, corner connector, downspout connector, and downspout cap comprises a plastic material.

15. The guttering system of claim 14, wherein said plastic material is vinyl.

* * * * *